United States Patent [19]

Schiemichen

[11] 4,073,155

[45] Feb. 14, 1978

[54] SEA PLATFORM CONSTRUCTION

[75] Inventor: Peter Schiemichen, Hunxe, Germany

[73] Assignee: Deutsche Babcock Aktiengesellschaft, Germany

[21] Appl. No.: 730,296

[22] Filed: Oct. 7, 1976

[30] Foreign Application Priority Data

Oct. 9, 1975 Germany ..... 2545219

[51] Int. Cl.[2] ..... F02D 23/02; E02B 17/08

[52] U.S. Cl. ..... 61/88; 61/90; 61/91

[58] Field of Search ..... 61/87, 88, 90, 89, 92, 61/86, 94, 91

[56] References Cited

U.S. PATENT DOCUMENTS

| | | | |
|---|---|---|---|
| 2,900,794 | 8/1959 | Sutton | 61/88 |
| 3,020,956 | 2/1962 | Suderow | 61/86 X |
| 3,036,438 | 5/1962 | Sims | 61/87 X |
| 3,138,932 | 6/1964 | Kofahl et al. | 61/87 |
| 3,412,564 | 11/1968 | McClintock | 61/88 |
| 3,501,919 | 3/1970 | Marshall | 61/94 |
| 3,528,254 | 9/1970 | Graham | 61/88 |
| 3,545,539 | 12/1970 | Manning | 61/94 X |
| 3,714,788 | 2/1973 | Mott | 61/89 |

*Primary Examiner*—Dennis L. Taylor
*Attorney, Agent, or Firm*—McGlew and Tuttle

[57] ABSTRACT

A sea platform includes a first part which comprises a floatable platform or deck having a plurality of supporting legs which extend therethrough and which may be elevated and lowered by an elevating mechanism. A second part comprises a floatable base which is adaptable to be lowered to the sea bed. A plurality of second legs extend upwardly from the base and they include open tops in an uppermost chamber of a size to receive the lowermost ends of the first legs therein in telescopic interengagement. Both the first and second parts are floatable out to the location to be of use and the base is then flooded in order to submerge it to the sea bed. The other part includes a floatable platform and it includes an elevating mechanism for each of its legs which may be lowered into the tops of the legs extending upwardly from the base after it arrives at the same location as the base. For the purpose of effecting the interengagement of the legs, the upper legs of the floatable platform are provided with a seal lock permitting access to a working chamber having a winch. The winch is connected to a cable which is extended out of the chamber and floats on a buoy on the sea during its movement to the sea location. The bottom legs each include a buoy connection to the interior of the uppermost chamber thereof and the two connections are removed from the buoy and interconnected and wound upon the winch in order to bring the legs carried by the platform downwardly into engagement with the second legs carried by the base and they may be locked together.

3 Claims, 2 Drawing Figures

SEA PLATFORM CONSTRUCTION

FIELD AND BACKGROUND OF THE INVENTION

This invention relates in general to the construction of sea platforms and, in particular, to a new and useful sea platform which is made up of two separable parts, one comprising a base and the other comprising a floatable platform, and each having legs which may be telescopically interengaged when the platform is erected over a sea floor.

THE PRIOR ART

Such sea platform or artificial island serves for drilling operations, drawing of earth's natural resources, such as mineral oil, or for accommodating power plants. In the artificial islands of the prior art, in most cases, the leg parts are connected to each other by means of externally located clamping devices. The work necessary therefor is controlled from the platform. There is no possibility of effecting or observing the operation from the interior of the legs at the level of the joint.

SUMMARY OF THE INVENTION

In accordance with the invention, the sea platform or artificial island includes two platform parts; a base part with legs which are interconnectable with legs carried by a platform part, which forms the upper portion of the structure. The lower end of the legs of the upper structure is equipped with a working chamber which opens downwardly and which is accessible through a lock and provided with compressed air connections. The water can be displaced downwardly from the lowermost chamber of the legs in the top part by means of the compressed air so that the operations necessary for connecting the parts can be effected from the interior under conditions of slight overpressure.

Accordingly, it is an object of the invention to provide a sea platform or artificial island made up of two parts, including a base part having a plurality of legs extending up from the base which is adapted to rest on the sea bed and a floatable platform part having a plurality of legs which may be elevated or dropped in respect to the platform by a suitable elevating mechanism, and which includes a compartment formed in the upper parts of the base part legs which permits telescopic interengagement with the lower part of the legs on the platform therewith to lock the two parts together at the erection location, and which also includes a lock chamber formed in the lower part of the legs carried by the platform with a compressed air connection for evacuating a winch compartment at the lower end of the legs which are opened downwardly into the sea so that the interconnection of these parts may be carried out by the dropping of the legs into the receiving portions of the legs on the base part by an operator positioned in the compartment work chamber.

A further object of the invention is to provide an artificial offshore island or sea platform construction, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

DESCRIPTION OF THE PREFERRED EMBODIMENT

Figure 1:
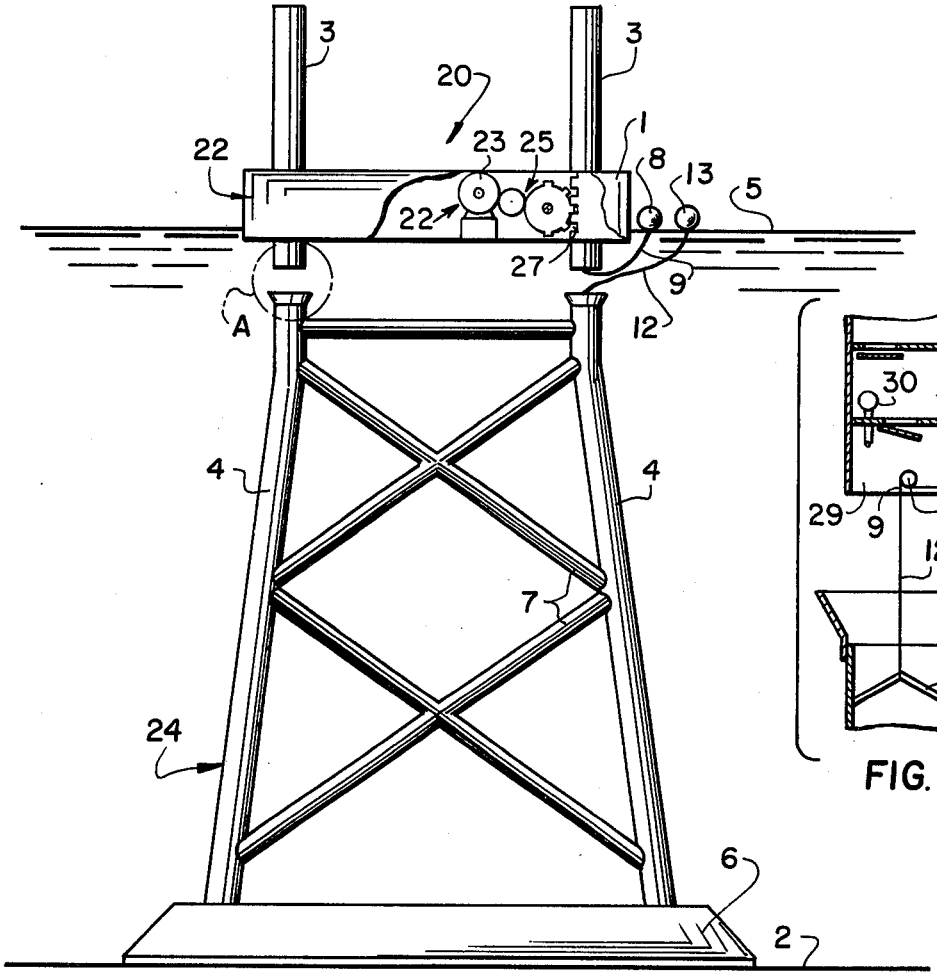
FIG. 1 is a diagrammatical lateral elevational view of an artificial island or sea platform constructed in accordance with the invention.

Referring to the drawings in particular, the invention embodied therein, comprises an artificial island or sea platform which includes a first part, generally designated 20, which includes a floatable platform 1 having four legs secured thereto which may be shifted relatively to the platform upwardly or downwardly by an elevating mechanism, generally designated 22. The elevating mechanism 22 includes a drive motor 23 and transmission 25 driving a rack formation 27 on each leg 3.

The sea platform includes a second part 24 which comprises a base 6 which may be ballasted to sink to the sea bed or sea floor 2 and which carries a plurality of second legs 4 which extend upwardly therefrom. The legs 3 of the upper or first part 20 are much shorter than the legs 4 of the lower part 24. The upper part comprises, for example, a tubing of relatively large diameter, for example, 6 m.

Legs 3 of the upper part have to be submerged to small depths of approximately 15 m below the water surface 5. From this position, it must be possible to elevate platform 1 to a level above the highest occuring wave which is usually around 25 m. Thus, with a constructional height of platform 1 of about 15 m, the length of the upper part legs 3 is approximately 55 m.

In the dockyard, platform 1, which is designed as a floatable body, is provided with all of the equipment necessary for subsequent operation. Thus, the platform, along with the legs 3 which are secured thereto, can be towed to a location of the sea mounting for the artificial island. The artificial island may be used as a power plant and, in such a case, the upper parts of legs 3 receive steam generators while the rest of the equipment is mounted on platform 1.

The legs 4 of the lower part 24 are supported on base 6 and are connected to each other by means of cross-braces 7 to form a supporting substructure. This substructure rests on sea floor 2, but initially at least, it is floatable and is lowered by floating the float tanks in the base 6 and, in some cases, also in the legs 4. As shown in FIG. 1, the substructure made up of the second part 24 is completely submerged. Depending on the sea depths at the location of installation, the height of the substructure or second part 24 may be, for example, 160 m and its upper end is about 15 m below water surface 5. As soon as the substructure 24 is installed, platform 1, with its first legs 3 jacked up, is brought into alignment with the substructure while floating on the surface 5 of the water. This phase is shown in FIG. 1 of the drawing. Then by actuating the elevating mechanism 22, legs 3 are jacked downwardly and thereby engage into legs 4 of the lower part 24.

Figure 2:
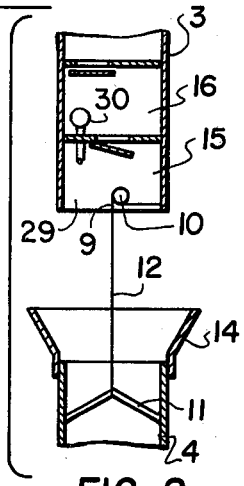
FIG. 2 is a partial large sectional view of the uppermost portion of a base leg and the lowermost portion of a platform leg shown in FIG. 1.

The mutual interengagement of the parts 3 and 4 is effected through positive guidance. To this purpose, in accordance with the invention, cable guides are provided which, as shown in FIG. 1, comprise a cable 9 connected to the leg part 3 and connected at its opposite end to a floating buoy 8 and a cable 12 connected to the leg part 4 and connection to a buoy 13 at its opposite end. As shown in FIG. 2, the cable 9 extends from buoy 8 to a winch 10 which is mounted in a work chamber 15 at the lower end of each leg part 3. The traction cable 12 is secured to a brace 11 at the upper compartment of the leg 4.

After initial positioning of the upper part 20, the cables 9 and 12 are removed from the respective buoys 8 and 13 and are connected to each other. Winch 10 is then operated to pull legs 3 downwardly into telescopic interengagement with the legs 4. At the same time, the upper legs 3 are jacked downwardly in respect to their associated platform 1. The two legs are then locked together and the purpose of the tight fastening is to prevent the floating platform 1 from being lifted by the surface waves and suddenly lowered which would involve the hazard of damaging the opposed edges of the parts 3 and 4. With such an arrangement, the assembly of the whole platform may be accomplished not only in a smooth sea but also under a sea having a light wave action.

During the lowering of the upper parts 3, a receiving funnel 14 provided on the head of each lower part 4 facilitates the engagement. In addition, upper parts 3 may comprise guide bars cooperating with receiving funnels 14.

The operations necessary for connecting parts 3 and 4 are performed from the interior of the legs and, for this purpose, the lower end of each of the upper parts 3 is provided with a working chamber 15 which is equipped with working platforms and guardrails, which have not been shown, as well as with the winch 10. The water is displaced from the working chamber 15 by means of a compressed air device 30, shown in FIG. 2. The necessary operations are then performed in the working chamber 15 under a slight excess pressure.

While a specific embodiment of the invention has been shown and described in detail to illustrate the application of the principles of the invention, it will be understood that the invention may be embodied otherwise without departing from such principles.

What is claimed is:

1. A sea platform adapted to rest on the sea floor, comprising a first part comprising a platform, a plurality of first legs extending through said platform, an elevating mechanism connected to said first platform and said legs for raising and lowering said legs relative to said platform, a second part comprising a floatable and ballastible base adapted to be flooded to sink in the water so as to rest on the sea floor, a plurality of second legs corresponding in number and relative location to said first legs connected to said base and extending upwardly therefrom, each of said second legs having a compartment adjacent the top thereof opening upwardly which is of a size to receive a respective one of said first legs therein in telescopic interengagement, said first legs including a working chamber at the lower end thereof opening downwardly into the sea and a lock above said working chamber for access to the working chamber, said working chamber having a compressed air connection thereto to pressurize said chamber to force the water therefrom for controlling the downward positioning of said first legs into said second legs.

2. A sea platform, according to claim 1, including a positive guide connected between said first and second legs for interengaging said legs together.

3. A sea platform, according to claim 1, including a cable connection to said working chamber of said first legs, a second cable connection to the working chamber of said second legs, said cable connections being adapted to be floated and interconnected together when the sea platform is to be erected, and winch means connected to said connected cables for moving said first and second legs together.

* * * * *